US005365609A

United States Patent [19]

Herzog

[11] Patent Number: 5,365,609

[45] Date of Patent: Nov. 22, 1994

[54] GOLF GLOVE WITH TEE HOLDER

[76] Inventor: William E. Herzog, 600 S. Riverside Rd., St. Joseph, Mo. 64052

[21] Appl. No.: 83,667

[22] Filed: Jun. 28, 1993

[51] Int. Cl.[5] ..... A41D 19/00

[52] U.S. Cl. ..... 2/161.4; 2/160; 2/917; 224/918

[58] Field of Search ..... 2/159, 160, 161 A, 161.1, 2/161.2, 161.3, 161.4, 162, 910, 917; 224/218, 219, 918, 919

[56] References Cited

U.S. PATENT DOCUMENTS

| | | | |
|---|---|---|---|
| 1,482,647 | 2/1924 | Gise | 224/219 |
| 3,272,412 | 9/1966 | Antonious | 224/918 |
| 3,556,364 | 1/1971 | Maretka | 224/918 |
| 3,588,917 | 6/1971 | Antonious . | |
| 3,629,867 | 12/1971 | Taylor | 224/219 |
| 3,847,110 | 11/1974 | Inoue . | |
| 4,069,954 | 1/1978 | Rauch | 224/918 |
| 4,330,120 | 5/1982 | Netti | 2/160 |
| 4,489,444 | 12/1984 | Graham | 2/160 |
| 4,639,947 | 2/1987 | Lanscioni | 2/161 A |
| 4,736,877 | 4/1988 | Clark . | |
| 4,993,613 | 2/1991 | Frisbie . | |
| 5,003,637 | 4/1991 | Lonon . | |

FOREIGN PATENT DOCUMENTS

| | | | |
|---|---|---|---|
| 300428 | 11/1928 | United Kingdom | 224/918 |

*Primary Examiner*—Clifford D. Crowder
*Assistant Examiner*—Diana L. Biefeld
*Attorney, Agent, or Firm*—Litman, McMahon & Brown

[57] ABSTRACT

The improved golf glove of the present invention is constructed to provide convenient, compact, and readily-accessible storage for a golf tee and a ball marker. The glove includes a hand-receiving glove portion having an overlapping flap type closure, a tee holder mounted atop the flap and having a series of channels of elastic or any other suitable material for securing tees in side-by-side relationship, and a retainer into which a ball marker may be easily inserted and removed using one hand. The marker retainer is coupled with the tee-holder and includes a slot for holding the marker base overlying the tee-holder with the tang projecting outwardly.

4 Claims, 1 Drawing Sheet

GOLF GLOVE WITH TEE HOLDER

BACKGROUND OF THE INVENTION

1. Field of the Invention

The present invention is broadly concerned with an improved golf glove which provides convenient, compact, and readily-accessible storage for golf tees and a ball marker. More particularly, it is concerned with a golf glove having a hand-receiving glove portion, a tee holder of elastic or any other suitable material, and a retainer into which a ball marker may be easily inserted and removed using one hand.

2. Description of the Related Art

Golf is a popular sport enjoyed around the world by millions of people of all ages. Players use clubs to sink a ball with as few strokes as possible into each of the nine or eighteen successive holes on a course. Players commonly wear spiked shoes to avoid damaging the greens and to maintain stance, as well as a golf glove on one hand to facilitate gripping the club. The game is normally played by groups of one to four golfers, who commence play towards each of the holes by driving the ball from a tee. Since golf courses schedule tee off times closely, to permit as many groups as possible to play in a day, it is desirable to play as expeditiously as possible.

Golfers have long been faced with the difficulties of transporting tees and ball markers around the links and keeping them conveniently at hand while leaving their hands free to play the game.

Although the golf bag generally used to transport the clubs includes pockets in which a supply of tees and markers may be stored and transported, such pockets are not well suited for providing easy access to small items. Even if a player were willing to walk to the bag and rummage through the pockets to obtain a tee, the process might have to be repeated if the tee were damaged while driving the ball, as it is sometimes necessary for a player to use more than one ball at a tee. In such cases repeated rummaging through the bag for additional tees would be required, thus slowing the game. While a golfer could retrieve several tees from the bag before teeing up, a storage problem would arise at the tee, since the hands must be kept free to grip the club during the drive.

Use of pockets in the golfer's clothing is similarly unsatisfactory. Items stored in the shirt pockets may fall out and be lost when the player bends to tee up or place a marker. Tees and markers are too sharp to be suitable for comfortable trouser pocket storage.

Previous devices have attempted to provide storage containers for tees, markers, and golf tools but do not provide a golf glove including accessible open holders for individual tees and markers of conventional construction which permit easy one-handed removal and replacement. U.S. Pat. Nos. 4,993,613 issued to Frisbie and 4,736,877 issued to Clark require attachment to a player's golf bag or belt. U.S. Pat. No. 5,003,637 issued to Lonon describes a closed, relatively bulky utility container for attachment to a golf glove. U.S. Pat. No. 3,847,110 issued to Inoue describes a golf score indicator for attachment to a golf glove. U.S. Pat. Nos. 4,639,947 and 4,489,444 issued to Lanscioni and Graham respectively, disclose a golf glove having an apertured flap which may be opened for access to a ball marker. U.S. Pat. No. 3,588,917 discloses a golf glove having hook-and-loop material for holding a marker fitted with complementary material. Heretofore there has not been available a golf glove having a holder for tees and a ball marker with the advantages of the present invention.

SUMMARY OF THE INVENTION

The present invention overcomes the problems previously outlined and provides a greatly improved golf glove having holders for tees and a ball marker. Broadly speaking, the glove includes a series of channels for securing tees to the glove in side-by-side relationship, and a retainer into which a ball marker may be easily inserted by sliding.

In particularly preferred forms, the golf glove includes an overlapping flap type closure and the tee-holder is mounted atop the flap. In still other preferred forms, the marker retainer is coupled with the tee-holder and includes a slot for holding the marker base overlying the tee-holder with the tang projecting outwardly.

OBJECTS AND ADVANTAGES OF THE INVENTION

The principal objects and advantages of the present invention include: providing golf tee and ball marker storage which is open and readily accessible to a golfer; providing such storage in which each item is separately secured; providing such storage which is compact and light weight; providing a golf glove which provides such storage; providing such a golf glove which permits easy, one-handed access to tees and markers for removal and replacement; providing such a golf glove which includes tee-holding channels of elastic or other suitable material; providing such a golf glove which includes a pocket for receiving a ball marker; providing such a golf glove which includes a pocket having a slot for slidably receiving a ball marker and for holding the marker in the pocket with the tang projecting outwardly from the slot; providing such a golf glove having a pocket with an opening oriented to permit the centrifugal force of the swing to force the marker inwardly into the holder; and providing a golf glove which can be easily modified to provide such storage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
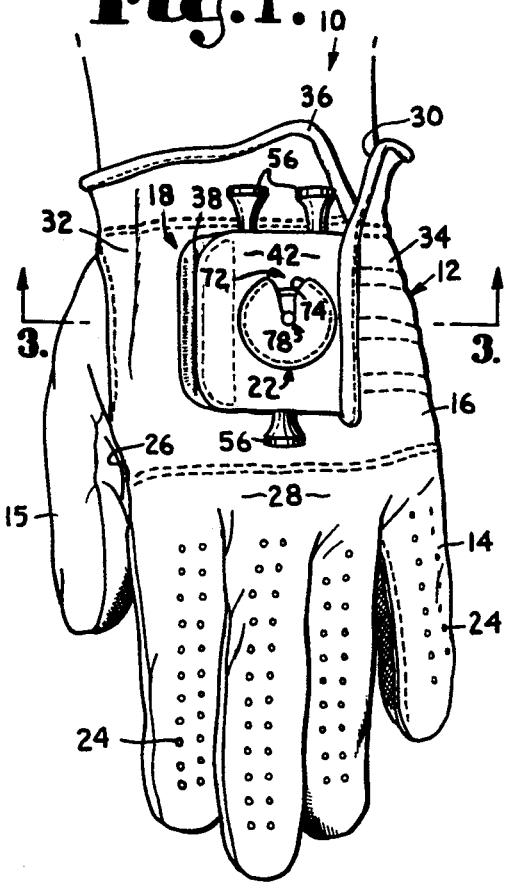
FIG. 1 is a top perspective view of the golf glove of the present invention showing golf tees and a ball marker in place in respective holders.
Figure 2:
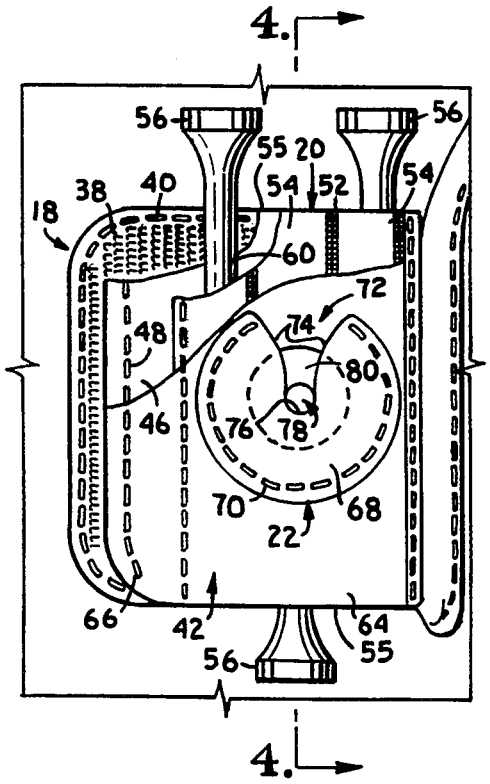
FIG. 2 is an enlarged, fragmentary plan view of the glove of FIG. 1, with parts broken away for clarity.
Figure 3:
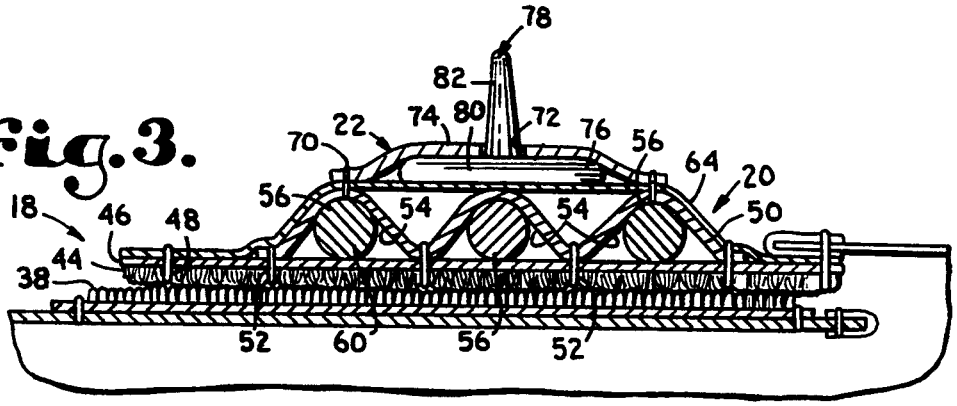
FIG. 3 is a cross section taken generally along line 3—3 of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, a golf glove with tee holder 10 in accordance with the invention includes a glove 12, having fingers 14, a thumb 15, a body 16, and closure assembly 18. A tee holder 20 is attached to closure assembly 18 and a ball marker holder 22 is disposed above tee holder 20.

In more detail, glove 12 is of flexible construction, preferably of leather and is perforated with ventilation holes 24 on the dorsal surface of fingers 14. In preferred embodiments, both dorsal and ventral finger surfaces are perforated. In certain embodiments the dorsal thumb surface may be perforated as well. Glove body 16 includes a ventral, palmar surface 26, and a dorsal, back surface 28 which is divided by an opening 30 into a lateral portion 32 adjacent the thumb 15 and a medial portion 34. Opening 30 is reinforced with piping 36 at the margins.

Glove closure assembly 18 includes a generally rectangular area of fabric loop fastener material 38, attached to lateral back surface 32 by a row of marginal stitching 40. A generally rectangular flap 42 is coupled with medial portion 34 so as to overlie fastener material 38 in mating engagement when in the closed position. Flap 42 includes an inner surface 44 of fabric loop fastener material and an outer surface 46 joined by a row of marginal stitching 48. In other embodiments, snaps, buttons, or any other suitable closure devices may be substituted for fabric loop fastener material or hook and loop fasteners in closure assembly 18.

Tee holder 20 includes a band 50 mounted atop flap 42 by spaced rows of stitching 52 which form tee-receiving channels 54, presenting a pair of open ends 55. In other preferred embodiments, band 50 may be mounted on glove 12 at any suitable location. Band 50 may be constructed of elastic or any other suitable material, such as, for example, woven synthetic fabric having a warp of rubberized filaments. Tees 56 each include a head 58, shaft, 60, and tapered end 62 and may be of wood, plastic, metal, or any other suitable material. An outer covering 64 is secured over band 50 by a row of marginal stitching 66.

Ball marker holder 22 includes a generally circular pocket 68 secured to tee holder outer covering 64 by a row of marginal stitching 70. In other embodiments, pocket 68 may be mounted directly to glove 12 at any suitable location and may be of any geometric configuration suitable to accommodate a ball marker. In still other embodiments, more than one pocket may be employed.

Pocket 68 is notched to present a slot 72 presenting proximally oriented converging curved edges 74 and distally oriented curvate end 76 to accommodate a marker 78 having a generally disk shaped base 80 coupled with a tang 82. In other embodiments, marker 78 may be of any suitable geometric configuration. Pocket 68 may be constructed of leather, synthetic resin, non woven synthetic fabric, cotton, or any other flexible material and may be imprinted, embroidered, or otherwise marked with a logo or design.

In other preferred embodiments, glove 12 includes tee holder 20, but not marker holder 22. Rows of stitching 40, 48, 52, 66, and 70 may be single or multiple, and gluing may be substituted for stitching where suitable. Where the components to be joined are of synthetic resinous material, fusion welding may be employed.

Figure 4:
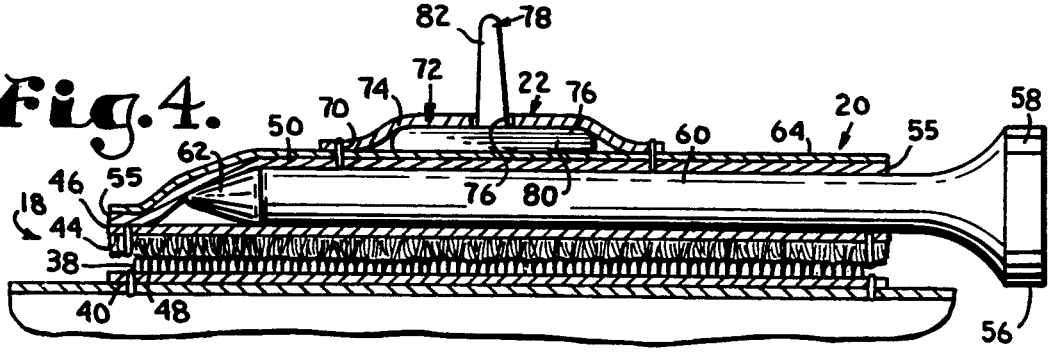
FIG. 4 is a cross section taken generally along line 4—4 of FIG. 2.

In use, a tee 56 is inserted into open end 55 of golf glove channel 54 by introducing tapered end 62 under band 50 and sliding shaft 60 into channel 54. Additional tees are inserted in side-by-side relationship in the adjacent channels 54. Tees may be inserted from either end of channels 54, according to user preference, or they may be alternated head-to-end in order to facilitate access to the heads for removal. As best shown in FIG. 4, band 50 urges channel ends 55 downwardly against outer flap surface 46 until a tee 56 is inserted into channel 54.

Tees 56 can be oriented with heads 58 facing the proximal side of the band and with ends 62 facing the distal side to permit the centrifugal force of the swing to force the tees distally into channels 54, with heads 58 serving as stops. However, band 50 secures the tees in place regardless of their orientation.

As tee 56 is introduced, band 50 stretches, tightly engaging the tee against flap surface 46 and securing it against loss. In preferred embodiments, channel 54 will stretch to accommodate tees of varying dimensions. A tee is removed by grasping the head 58 and sliding outwardly.

A ball marker 78 is inserted into holder 22 by sliding the base 80 past converging slot edges 74, along slot 72, and into pocket 68 with the tang 72 projecting outwardly through the slot until it contacts distal end 76, which serves as a stop. Pocket 68 engages base 80 against flap covering 64 in supporting relationship. During the swing, centrifugal forces act to urge marker 74 into pocket 68 and tang 72 towards end 76. A marker is easily removed for use at the next hole by grasping the projecting tang 72, which serves as a handle, and sliding the base outwardly from the pocket 68 along slot 72.

Advantageously, a golf glove of conventional construction may be easily modified to include holders 20, 22. Moreover, the golf glove with tee holder of the present invention obviates the need for additional accessories for tee and marker storage, such as belt mounted carriers and the like. The convenient location of tees 56 and ball marker 78 permits frequent, easy one-handed removal and replacement in the respective holders, 20, 22 during the course of the game.

It is to be understood that while certain forms of the present invention have been illustrated and described herein, it is not to be limited to the specific forms or arrangement of parts described and shown.

What is claimed and desired to be secured by Letters Patent follows:

1. A combination golf glove/holder for holding golf tees and for holding a ball marker, having a disc-shaped marker base and a marker tang projecting therefrom, comprising:

(a) a glove including finger-receiving portions coupled with a body having a palm portion and a back portion presenting first and second segments adjacent a glove opening, one of said back segments including a flap member having fastening means for fastening said first and second back segments in closed relationship to said glove opening;

(b) said flap member including a first layer presenting a first fastening surface, a second layer, a third tee-retaining layer including elongate channels presenting spaced openings at opposed ends for receiving golf tees therein, and an outermost covering layer;

(c) said channels including elastic tee-retaining means for receiving and securing said tees to said glove in side-by-side relationship;

(d) ball marker retaining means including a pocket having an opening and a slot coupled with said opening, said ball marker retaining means slidably receiving and securing said marker base overlying said channels with said marker tang projecting outwardly from said ball marker retaining means and slidably positioned within said slot;

(e) said ball marker retaining means pocket opening being oriented in a first direction proximal to the body of a wearer of said glove and away from said finger-receiving portions to permit centrifugal forces associated with a golf swing in a second, centrifugal force directed to urge said marker in said centrifugal force direction, into said pocket and toward said finger-receiving portions; and (f) said marker retaining means being coupled with said covering layer.

2. A combination golf glove-holder for holding a golf tee, which comprises:

(a) a glove including finger-receiving portions coupled with a body having a palm portion and a back presenting first and second segments adjacent a hand opening, one of said back portion segments including a flap member having fastening means for fastening said first and second back portion segments in a closed relationship to said hand opening;

(b) said flap member including a first layer presenting a first fastening surface, a second layer, and a third tee-retaining layer including an elongate channel presenting openings at opposed ends for receiving golf tees therein;

(c) said fastening means comprises a hook-and-loop fastener with a hook portion mounted on one of said flap member and said other back portion segment and a loop portion mounted on the other of said flap member and said other back portion segment;

(d) said tee-retaining layer comprising an elastic material attached to said flap member on an outer surface thereof by a plurality of stitch lines, each said stitch line extending through said elastic material, said flap member and one of said hook-and-loop portion;

(e) said stitch lines extending in parallel relation in a direction generally longitudinally aligned with said finger-receiving portions;

(f) said elongate channel being formed between said elastic material, said flap member and said stitch lines for receiving and retaining said tee therein; and (g) said elastic material of said tee-retaining layer having a stretched configuration with said flap member fastened to said glove back portion and a relaxed configuration with said flap member disengaged from said glove back portion.

3. The invention of claim 2, which includes:

(a) said tee-retaining layer forming multiple, juxtaposed channels each adapted for receiving a respective golf tee.

4. A combination golf glove/holder for holding a ball marker having a marker base and marker tang, which combination golf glove/holder comprises:

(a) said glove including finger-receiving portions coupled with a body having a palm portion and a back portion presenting first and second segments adjacent a hand opening, one of said back portion segments including a flap member having fastening means for fastening said first and second back portion segments in closed relationship to said hand opening, said fastening means comprising a hook-and-loop fastener with a hook portion mounted on one said flap member and the other back portion segment and a loop portion mounted on the other of said flap member and the other back portion segment;

(b) said flap member including a first layer presenting a first fastening surface with one of said fastener portions, a second layer, and a third marker-retaining layer;

(c) ball marker retaining means associated with said marker-retaining layer and including a pocket having an opening and a slot coupled with said ball marker retaining means pocket opening, said ball marker retaining means slidably receiving and securing said marker base overlying said flap member with said marker tang projecting outwardly from said ball marker retaining means and slidably positioned with said slot.

* * * * *